US008531259B2

(12) United States Patent
Chen et al.

(10) Patent No.: US 8,531,259 B2
(45) Date of Patent: Sep. 10, 2013

(54) PROPORTIONAL ELECTROMAGNET

(75) Inventors: Chuen-An Chen, Taoyuan County (TW); Chieh Tung, Taoyuan County (TW); Che-Pin Chen, New Taipei (TW); Min-Fang Lo, Taoyuan County (TW); Yao-Ming Huang, Taoyuan County (TW)

(73) Assignee: Chung-Shan Institute of Science and Technology, Armaments, Bureau, Ministry of National Defense, Taoyuan County (TW)

( * ) Notice: Subject to any disclaimer, the term of this patent is extended or adjusted under 35 U.S.C. 154(b) by 0 days.

(21) Appl. No.: 13/315,396

(22) Filed: Dec. 9, 2011

(65) Prior Publication Data

US 2012/0313739 A1 Dec. 13, 2012

(30) Foreign Application Priority Data

Jun. 10, 2011 (TW) ..... 100120280 A

(51) Int. Cl.
*H01F 7/08* (2006.01)

(52) U.S. Cl.
USPC ..... 335/220; 335/282

(58) Field of Classification Search
USPC ..... 335/220
See application file for complete search history.

(56) References Cited

U.S. PATENT DOCUMENTS

| | | | | |
|---|---|---|---|---|
| 4,468,647 | A * | 8/1984 | Gibas | 335/262 |
| 5,992,822 | A * | 11/1999 | Nakao et al. | 251/129.15 |
| 6,615,780 | B1 * | 9/2003 | Lin et al. | 123/90.17 |
| 6,628,186 | B1 * | 9/2003 | Wolfges | 335/220 |
| 6,814,339 | B2 * | 11/2004 | Berger et al. | 251/129.1 |
| 7,688,169 | B2 * | 3/2010 | Zhao | 335/220 |
| 2006/0038645 | A1 * | 2/2006 | Hoffman | 335/220 |

FOREIGN PATENT DOCUMENTS

JP 02281528 A * 11/1990

* cited by examiner

*Primary Examiner* — Elvin G Enad
*Assistant Examiner* — Lisa Homza
(74) *Attorney, Agent, or Firm* — Jackson IPG PLLC

(57) ABSTRACT

A proportional electromagnet includes a cylindrical shell, first and second covers connected to two ends of the shell by riveting, a metal core inserted through an axial defined in the second cover and formed with a first section located in the shell and a second section located outside the shell, a coil unit provided between the shell and the metal core, a supporting element provided on the first section of the metal core, a bushing provided on the second section of the metal core, a copper ring provided on the first section of the metal core to improve magnetic thrust of the proportional electromagnet, a stop provided on the first section of the metal core, and a magnetic shield provided between the first section of the metal core and the coil unit to direct magnetic flux toward the supporting element and the metal core to stably drive the metal core.

10 Claims, 4 Drawing Sheets

PROPORTIONAL ELECTROMAGNET

BACKGROUND OF INVENTION

1. Field of Invention

The present invention relates to an electromagnet and, more particularly, to a proportional electromagnet.

2. Related Prior Art

An electromagnet is used for turning electricity into magnetism and often used where intermittent movement is desired. The electromagnet includes a coil around a metal core which includes a bore defined in an end. The bore jeopardizes the density of the magnetism. Therefore, the magnetism is not constant in an operative stroke.

Referring to FIG. 4, shown is a conventional electromagnetic apparatus 5 that includes a magnetic circuit. The magnetic circuit goes from a coil unit 51 into a magnetic shield via a first bushing 52, a magnetic lining 53, a first air gap 54, a metal core 55. Then, the magnetic circuit is divided into two branches. One of the branches goes into a second air gap 56. The other branch goes into a supporting element 58 via a flange 57. Then, the magnetic circuit returns into the coil unit 51 via a second bushing 59. The bushings 52 and 59 and the air gaps 54 and 56 and the flange 57 are magnetic air gaps that exhibit a magnetic resistance about 400 to 800 times as high as magnetic metal about a same distance and area. Hence, an electromagnetic apparatus will operate inefficiently if includes many magnetic air gaps.

The present invention is therefore intended to obviate or at least alleviate the problems encountered in prior art.

SUMMARY OF INVENTION

It is an objective of the present invention to provide a proportional electromagnet for providing substantially constant magnetism during an operative stroke.

To achieve the foregoing objective, the proportional electromagnet includes a cylindrical shell, first and second covers connected to two ends of the shell by riveting, a metal core inserted through an axial defined in the second cover and formed with a first section located in the shell and a second section located outside the shell, a coil unit provided between the shell and the metal core, a supporting element provided on the first section of the metal core, a bushing provided on the second section of the metal core, a copper ring provided on the first section of the metal core to improve magnetic thrust of the proportional electromagnet, a stop provided on the first section of the metal core, and a magnetic shield provided between the first section of the metal core and the coil unit to direct magnetic flux toward the supporting element and the metal core to stably drive the metal core.

Other objectives, advantages and features of the present invention will be apparent from the following description referring to the attached drawings.

BRIEF DESCRIPTION OF DRAWINGS

The present invention will be described via detailed illustration of the preferred embodiment versus prior art referring to the drawings wherein.

DETAILED DESCRIPTION OF PREFERRED EMBODIMENT

Figure 1:
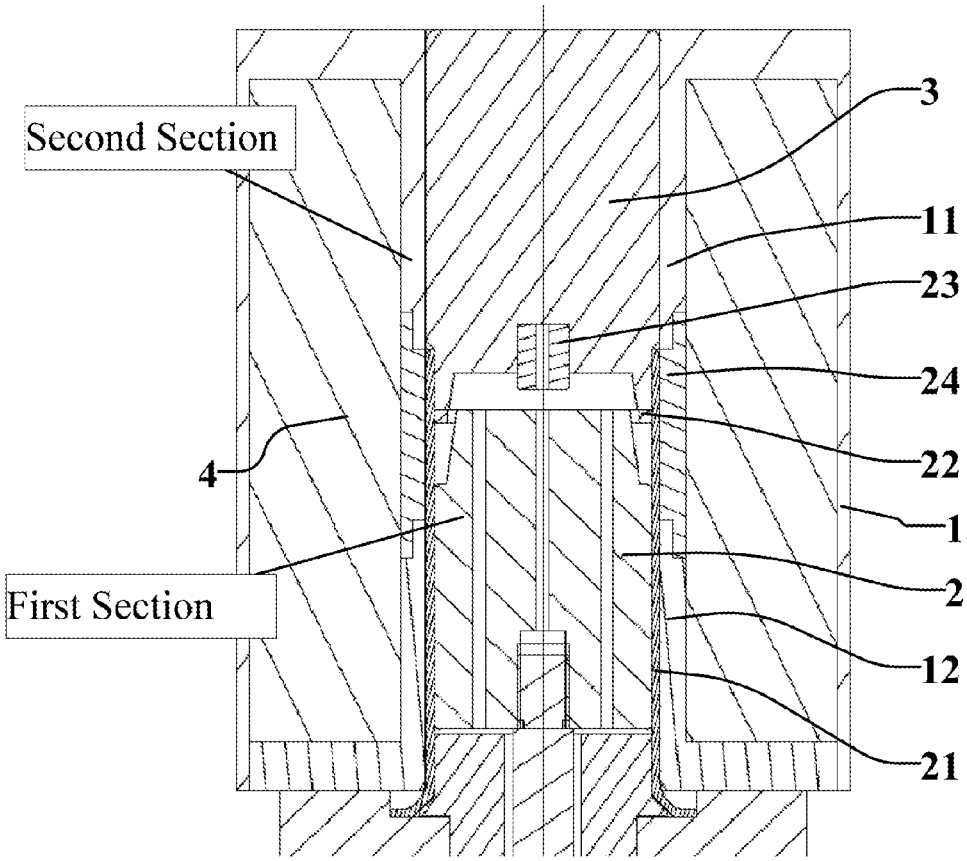
FIG. 1 is a cross-sectional view of a proportional electromagnet according to the preferred embodiment of the present invention.
Figure 2:
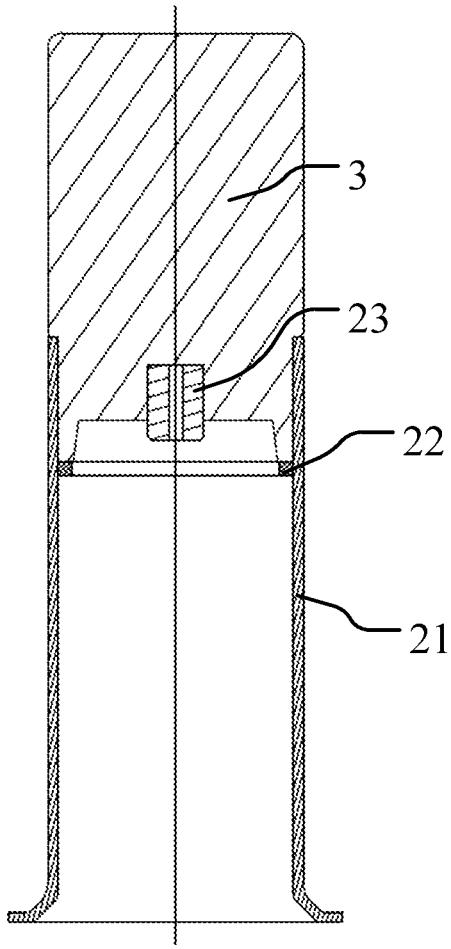
FIG. 2 is a side view of a core of the proportional electromagnet shown in FIG. 1.

Referring to FIGS. 1 and 2, the proportional electromagnet includes a liner 21, an iron core 2, a base seat 3 and a coil unit 4 according to the preferred embodiment of the present invention. The bushing 1 is a cylindrical shell made of a sheet by rolling. Two covers, a bottom cover 11 and a top cover 12 respectively are secured to two ends of the bushing 1 by rivets for example.

The iron core 2 is inserted in the liner 21 and defines an aperture. The liner 21 includes a first end located outside the iron core 2 and a second end inserted in the bottom cover 11 and connected to the base seat 3. Between the bushing 1 and the iron core 2 is provided the coil unit 4.

A horn-shaped base seat 3 is connected to the second end of the liner 21 with a copper ring 22 and a stop 23. The copper ring 22 acts to avoid magnetic leakage and improve proportional linearity of magnetic thrust of the proportional electromagnet. Between the bottom cover 11 and the top cover 12 is provided a flange functioning as a magnetic isolation ring or magnetic shield 24. The iron core 2 and the base seat 3 are made of a same magnetic material or different magnetic materials. The liner 21 and the stop 23 are made of stainless steel that is non-magnetic. The flange 24 is made of copper. The stop 23 is used to control the shortest distance between the base seat 3 and the iron core 2 when they are attracted to each other because of magnetic excitement.

Figure 3:
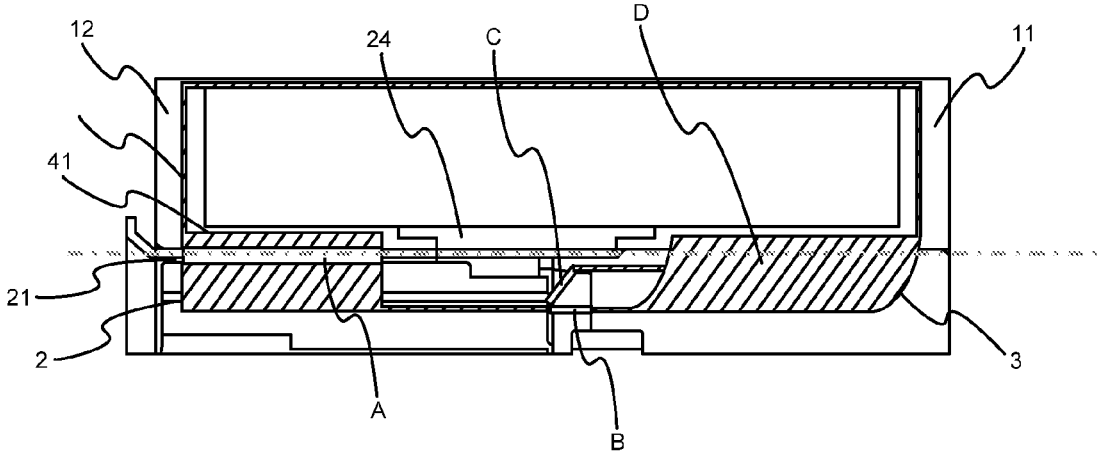
FIG. 3 shows magnetism produced by the proportional electromagnet shown in FIG. 1.
Figure 4:
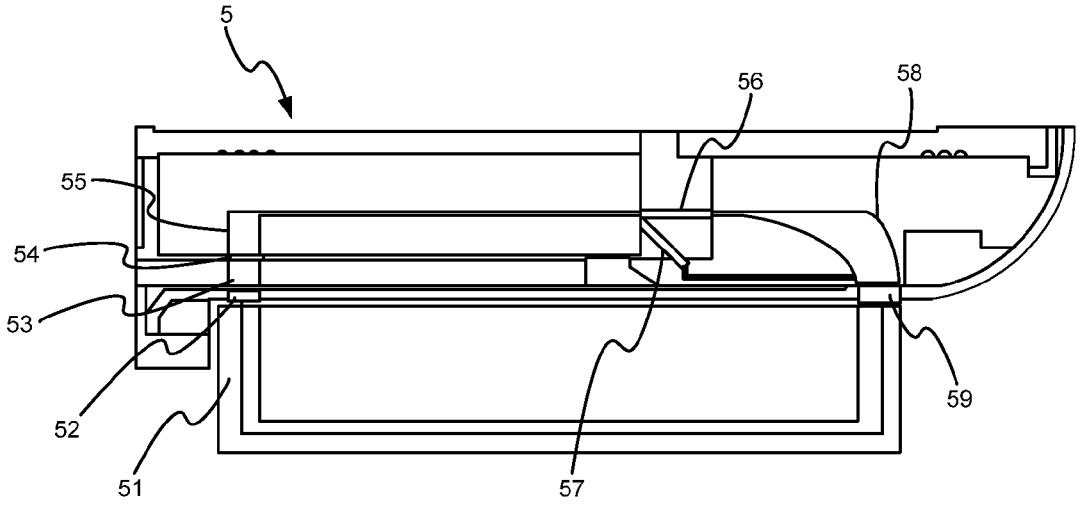
Fig. 4 (PRIOR ART)
FIG. 4 shows magnetism produced by a conventional electromagnet.

The present invention exhibits several advantageous features over the prior art. At first, subjected to a same electromotive force ("NI"), the present invention produces a magnetic circuit to provide a larger electromagnetic force than the prior art. Referring to FIG. 3, "A" stands for a non-magnetic metal magnetic circuit, "B" and "C" represent air gaps, and "D" refers to a magnetic metal magnetic circuit. The bushing 1, the bottom cover 11, the top cover 12, and the flange 24, in combination, define a sleeve. The magnetic circuit goes from the bottom cover 11 "D", the liner 21 "A" and the iron core 2 "D". Then, the magnetic circuit is divided into two branches. One of the branches goes axially through the air gap "B". The other branch goes radially to the horn-shaped end of base seat 3 through the air gap "C". Then, the magnetic circuit goes into the base seat 3 and the top cover 12 "D". The air gaps B and C produce magnetic circuits that are necessary for the proportional function while there is only the non-magnetic magnetic circuit A. The area of the magnetic circuit is 4 times as large as that of the prior art. The proportion of the air gaps B and C is reduced, and the magnetic resistance of the air gaps B and C is also reduced. Hence, the present invention provides a larger electromagnetic force than the prior art.

Secondly, a conical surface is used instead of a conventional wedge-like surface. Therefore, the present invention can be made more easily than the prior art without jeopardizing the performance.

Thirdly, the liner 21 is directly secured to the base seat 3 by welding instead of the conventional caps that involve more difficult fabrication.

Fourthly, the present invention exhibits less magnetic resistance than the prior art because that the to cover 12 is in direct contact with the base seat 3.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A proportional electromagnet including:

a bushing with a cylindrical configuration and made of magnetic material;

bottom and top covers connected to two ends of the bushing respectively and each made of magnetic material;

a base seat made of magnetic material and in direct contact with the top cover;

a liner, of which one end is inserted in the bottom cover and directly welded to the base seat and made of non-magnetic material;

an iron core with a conical surface at one end and inserted through the liner and wherein the liner defines a first section located in the liner and wherein the base seat is provided on the first section and defines a second section located outside the liner;

a coil unit provided between the bushing and the iron core;

a copper ring provided on the first section between the iron core and the base seat to avoid magnetic leakage and improve proportional linearity of magnetic thrust of the proportional electromagnet;

a stop provided on the first section of the base seat; and a flange made of magnetic material and acting as a magnetic shield provided between the bottom cover and the top cover to direct magnetic flux toward the base seat and the iron core to stably drive the iron core wherein the liner defines a non-magnetic material portion of a magnetic circuit and where the base seat, the iron core, the bottom cover, and the top cover, in combination, define a magnetic material portion of the magnetic circuit.

2. The proportional electromagnet according to claim 1, wherein the iron core includes an aperture defined therein.

3. The proportional magnet according to claim 1, wherein the coil unit includes:

a coil and a sleeve comprising the bushing, the bottom cover, the top cover, and the flange, in combination, provided around the coil.

4. The proportional magnet according to claim 3, wherein the flange and the coil are made of copper.

5. The proportional magnet according to claim 1, wherein the liner is made of stainless steel that is non-magnetic.

6. The proportional magnet according to claim 1, wherein the stop is made of stainless steel that is non-magnetic.

7. The proportional magnet according to claim 6, wherein the stop controls the shortest distance between the iron core and the base seat after magnetic excitation.

8. The proportional magnet of claim 1, wherein the magnetic circuit is divided into a first branch extending axially through a first air gap and a second branch extending radially through a second air gap.

9. The proportional magnet of claim 8, wherein the magnetic circuit goes from the bottom cover, the liner, and the iron core and then divides into the first branch extending axially through the first air gap and the second branch extending radially to the end of the base seat through the second air gap and wherein the magnetic circuit then goes into the base seat and the top cover.

10. The proportional magnet of claim 9, wherein the magnetic circuit provides electromagnetic force independent of the distance between the iron core and the base seat within a definite range, the electromagnetic force just proportional to the electrical power input.

* * * * *